US006206742B1

(12) United States Patent
Bull et al.

(10) Patent No.: US 6,206,742 B1
(45) Date of Patent: Mar. 27, 2001

(54) BUOYANCY DEVICE AND METHOD FOR USING SAME

(75) Inventors: Henrik Bull, Asker; Helge Ingebretsen, Svelvik, both of (NO)

(73) Assignee: ABB Offshore Technology AS, Nesbru (NO)

( * ) Notice: Subject to any disclaimer, the term of this patent is extended or adjusted under 35 U.S.C. 154(b) by 0 days.

(21) Appl. No.: 09/341,721

(22) PCT Filed: Jan. 13, 1998

(86) PCT No.: PCT/NO98/00011

§ 371 Date: Aug. 20, 1999

§ 102(e) Date: Aug. 20, 1999

(87) PCT Pub. No.: WO98/31916

PCT Pub. Date: Jul. 23, 1998

(30) Foreign Application Priority Data

Jan. 15, 1997 (NO) ..... 970188

(51) Int. Cl.[7] ..... B63B 22/00

(52) U.S. Cl. ..... 441/1; 441/23; 441/133; 405/195.1

(58) Field of Search ..... 405/195.1, 224.2, 405/224.4, 171; 114/264, 293, 265; 441/1, 23, 133; 166/350, 367

(56) References Cited

U.S. PATENT DOCUMENTS 4,400,110 * 8/1983 Beynet et al. ..... 405/224.2
4,793,737 * 12/1988 Shotbolt ..... 405/169
5,957,074 * 9/1999 De Baan et al. ..... 114/293

* cited by examiner

*Primary Examiner*—Sherman Basinger
(74) *Attorney, Agent, or Firm*—Cohen, Pontani, Lieberman & Pavane

(57) ABSTRACT

A method and a buoyancy device adapted to impart buoyancy to at least one longitudinal element submerged in water. The buoyancy device is hollow and is preferably made of plastic or a similarly corrosion-resistant material. The device is preferably produced as one single unit, but may include several separate chambers which, via valves, may be brought into communicating connection with the surroundings, in a controlled manner. The device will therefore not be subjected to large differential pressures in use, and accordingly may have relatively thin walls. The buoyancy device has a much lower weight than prior-art buoys, is simpler to assemble, and is not subject to corrosion.

11 Claims, 2 Drawing Sheets

BUOYANCY DEVICE AND METHOD FOR USING SAME

Figure 1:
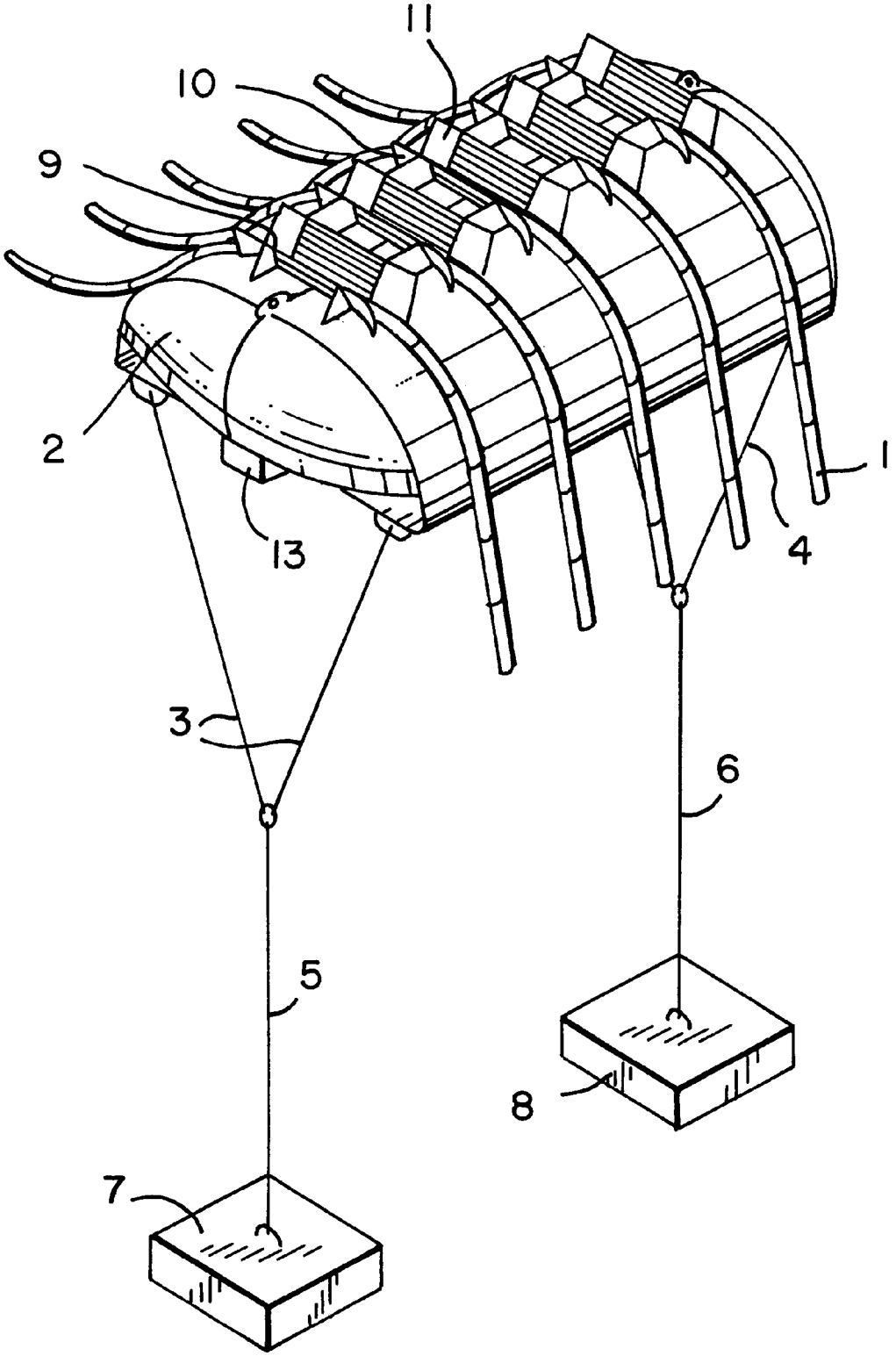

The present invention relates to a method for locally imparting additional buoyancy to a longitudinal body emerged in water, and also relates to a buoyancy device adapted to perform said method.

The invention in particular relates to use in connection with plants comprising risers and/or umbilicals arranged between a submarine connection and a floating equipment positioned at the surface. The invention in particular relates to a plant comprising dynamic risers of a flexible type or so-called "umbilicals", passing from the seabed to a vessel or to a platform not standing on the seabed, but moving in a flexible mooring. A buoyancy device according to the present invention will reduce the strain in the risers, a strain caused by the weight of the risers themselves and possible loads. The riser cables and/or the pipes will in a conventional manner rest on the buoyancy device having the shape of a buoy, and enclose the same along an angle extending to a maximum of 180°. Conventionally such buoyancy devices are anchored to the seabed by wires, steel ropes or chains, so that the buoyancy devices are positioned and maintained in the water between the seabed and the surface.

In connection with previously known buoyancy devices used in connection with dynamic risers, e.g. a buoy developed for use on the Guillemot oil field, separate pressure tanks made of steel have regularly been used, and these tanks are in turn connected to a steel structure including a frame and recesses with a shape adapted to risers. Such previously known pressure tank systems lead to many disadvantages, of which the most important ones are mentioned below. It is also referred to U.S. Pat. Nos. 4,793,737 and 5,505,560, giving examples of similar techniques.

Conventional pressure tanks are often made from steel. Steel is heavily corroded when exposed to sea water, and accordingly the tanks have to be dimensioned to resist the pressure of water at the working depth. As a result the buoy will be very heavy and must be installed by means of specific vessel having a derrick with a sufficient lifting capacity for the heavy steel buoys. In addition the buoys have to be filled by air already on the surface to avoid internal corrosion problems that have to arise if water would be pumped out of the tank after installation. Accordingly the buoy has to be pulled down to its desired position due to the large buoyancy, before installation. The buoyancy and therefore also the volume must be exceptionally large, as the buoyancy must compensate the high intrinsic weight of the buoy, again due to the use of steel. Even if internal corrosion is avoided as seawater never comes in contact with the inner side of the buoyancy device, a thorough external corrosion protection must be obtained by means of surface protection and sacrificial anodes. All these precautions result in very high costs during the mounting process and during maintenance. Regular inspections are also required to avoid damages due to corrosion.

The object of the present invention is to provide a new buoyancy device adapted to be used in connection with dynamic riser systems where the above-mentioned disadvantages are avoided. This is partly obtained by using a new method during deployment, as the buoyancy device is laid out while the substantial part of the internal volume of the buoyancy device communicates freely with the surroundings. This feature ensures that the structure of the buoyancy device is not exposed to large and detrimental external pressures.

Accordingly also the internal volume of a buoyancy device according to the present invention will be exposed to seawater during the laying out operation. Such exposure is accepted as the new construction preferably is manufactured from a material being corrosion resistant against sea water. A preferred material may be glass reinforced plastics (GRP), however, other composites reinforced by fibres may also be used.

The features mentioned above also give other advantages for buoyancy devices according to the present invention. As composite materials having fibre reinforcement, e.g. built up from KEVLAR or GRP are materials with a low density, the requirements to hoisting capacity are reduced drastically. The low weight also makes it possible to collect several buoyancy devices on the site by means of one minor vessel, which again reduces the on-site mounting costs further. In addition the buoyancy device may be installed in a completed version, i.e. including the anchoring lines connected to the buoy while the weight of this line may be compensated in advance by means of internal or external buoyancy elements. However, this does not exclude that the anchoring line instead may be connected first when the buoyancy element has been lowered down to the site. Accordingly the mounting method will be very flexible and may be adapted to local conditions. The buoy may be designed so that it is neutral (neither sinking nor floating) or has limited buoyancy when submerged in water.

The selected material ensures that corrosion problems will not arise, and this again makes it possible to use later filling with air and controlling of the overpressure in the buoyancy chambers. Even ballasting by use of seawater may take place without problems.

The shape of the design also gives the solution according to this invention a very high flexibility and freedom to select shapes and designs appropriate for the using conditions. As an example the saddles by which the risers are supported may be implemented directly on the external surface of the buoyancy device. The design of the body of the buoyancy element itself, accordingly may be adapted to the minimum accepted bending radius of the dynamic riser or umbilical used. Integrating the buoyancy tank or the buoyancy tanks in the buoyancy element will also be simple, and the buoyancy device may be moulded as one single unit of GRP material or a similar suitable artificial material, such as a composite material comprising reinforcing fibres.

Finally the buoyancy device may comprise a plurality of internal chambers of suitable shape and arrangement, and each such internal chamber may be provided with valves which again allow filling of selected chambers with seawater when used as ballast chambers, while other chambers may be filled by a gas, preferably air, to adjust the buoyancy. When the buoyancy tank or tanks consisting of GRP material are filled with air, they may be filled until the air pressure corresponds to the prevailing water pressure at this depth, and therefore the walls of the buoyancy device will not be exposed to a large, external pressure, which, in connection with conventional solutions, could bring the buoyancy chambers to implode.

Finally the tank or the tanks may be equipped with excess pressure valves to prevent over-pressure within the tank during filling with air. If an internal excess pressure value is used, a possible leak will result in some air bleeding out before the device reduces its buoyancy. Therefore, a possible leak may be detected before a detectable reduction of the buoyancy itself has ocurred.

Figure 2:
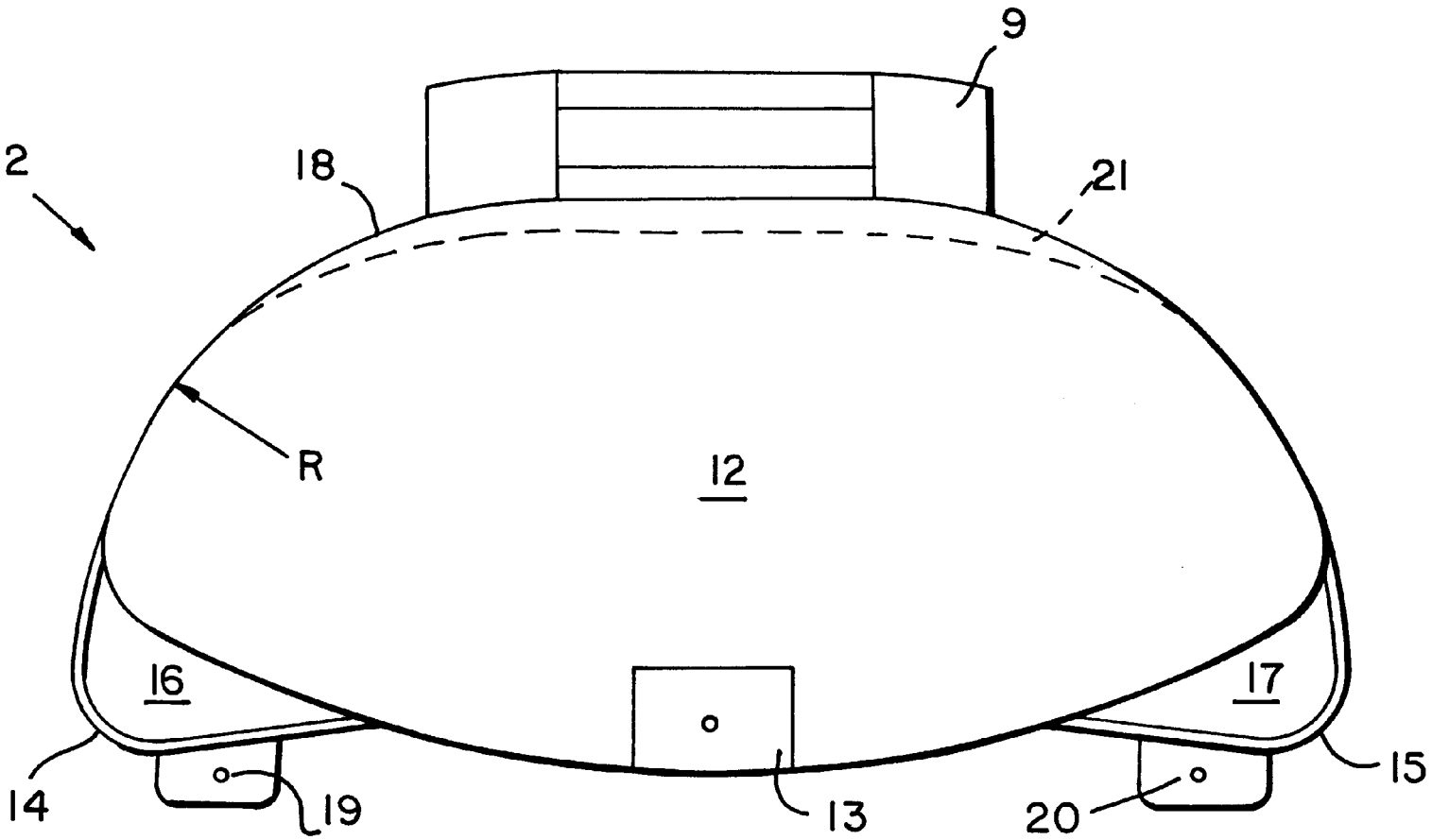

To give a more clear and unambiguous understanding of the present invention, it is referred to the detailed description of an embodiment given below, and to the accompanying drawings in which:

FIG. 1 shows a buoyancy device designed to support the complete weight or a part of the weight of one or more riser cables or similar elements, in perspective view, and FIG. 2 shows a cross section through a buoyancy device to give a better understanding of the sub-division in separate compartments and the more detailed design of the buoyancy device.

Already now it may be pointed out that the same reference numbers are used in both figures when found appropriate, that the scales used on the different figures or within each single figure not necessarily are identical, and that the drawings mainly are meant to explain the principle of the invention while details of the design not required to understand the invention, may be omitted to avoid crowded drawings.

In FIG. 1 a section comprising five riser cables 1 is shown. These cables may be several hundred meters long, but on the figure only a short length is shown where the cables are passing over a longitudinal buoyancy device 2, supported by the same. The buoyancy device 2 on the figure is anchored by lines 3,4 connected to wires 5,6 which in turn are connected to heavy anchoring plates 7,8 on the seabed. All such equipment is of course surrounded by water so that the buoyancy device 2 is floating in a level above the seabed determined by the length of the wires 5,6 and the anchoring lines 3,4.

The buoyancy device is on its upper side provided with guiding recesses 9 to accomodate each single cable 1, and these guiding recesses may preferably be made as wedge-shaped openings between two protruding ribs 10,11 to accommodate cables 1 having different outer diameters.

The buoyancy device 2 may be constructed from a thin material which not necessarily has high mechanical strength, however, a very corrosion resistant material compatible to sea water, and the material may preferably have surfaces protected against fouling.

When the buoyancy device shall be positioned, valves 13, which represent a communication between the interior of the buoyancy device and its exterior, are kept in their open positions so that portions of the internal volume more or less will be filled with water. Accordingly the internal and external pressure of the buoyancy device 2 will be equal during the submerging procedure. It should already now be pointed out that the internal volume of the buoyancy device 2 may be subdivided in a plurality of chambers, each having one or more valves 13 communicating with the surroundings. Thus, each single chamber may be filled with water or even with a liquid having a higher density than water, for ballasting, while other portions of the internal volume may be filled by gas or, as mentioned above, may communicate directly with the surrounding sea water to be filled by same. Normally the buoyancy device 2 will, before being submerged in water, have its buoyancy adjusted in such a manner that it will sink in water and at the same time being ballasted in such a manner that it will be oriented with the saddle and its guiding recesses 9 facing upwards and with its anchoring eyes or devises 19,20 facing downwards as shown in FIG. 2. All the chambers ought to be or may be filled with liquid during the submerging process. Necessary buoyancy may be obtained by separate buoyancy members which possibly may be integrated within the tank.

When the buoyancy device 2 has reached correct depth and has been anchored to the anchoring plates 7,8, the buoyancy of the complete buoyancy device may be adjusted by filling some of the chambers with additional gas, e.g. by means of divers or by means of an ROV (remote operated vehicle). Once the buoyancy has been adjusted as wanted, the valves are closed.

In this manner a stable support of one or a plurality of cables 1 may be obtained between the seabed, on the cables' path towards the surface. Several such buoyancy devices may of course be used, possibly mounted at different levels above the seabed, and adjusted to relieve a certain percentage of the total strain of the cable.

When details of the construction are considered, it is referred to FIG. 2 which shows a cross section through a buoyancy device 2 according to FIG. 1.

Within the shown cross section the main chamber of the buoyancy device consists of one separate chamber or space 12. However, the buoyancy device 2 may be separated in several chambers or compartments, e.g. by means of cross-wise or longitudinal partitions in the shown chamber 12. Each of the chambers obtained has to be equipped with a communication channel to the surroundings, e.g. via the valve panel 13 as shown on the figure.

In FIG. 2 it is also assumed that additional ballasting chambers 16,17 may be arranged, e.g. as in the shown embodiment within beads 14,15 arranged at diametrical opposite side edges of the buoyancy device 2. These further ballasting chambers 16,17 may be provided with separate valves (not shown), e.g. adapted for filling with water or similar fluid. On the figure it is also assumed that the surface 18 pointing upwards, has such a shape that the cables 1 supported by the surface 18 of the buoyancy device, have to be configured according to the shape of this surface. Accordingly it is an advantage that the design is accomplished so that the cable cannot obtain a curve having a radius with a detrimental small radius, as shown at R. The beads 14,15 have not to be hollow and enclose ballasting chambers. Alternatively the beads 14,15 may possibly only be a structure designed as a "skirt" to support the riser where it leaves the buoyancy device.

As understood from FIG. 2, the saddle 9,10 may at the upper surface 18 of the buoyancy device 1 be integrated in the wall of the device and either may be moulded together with same or made separately and later fastened to the device in a conventional way. Similarly a partition (shown with dashed lines on the figures) may be arranged to separate one upper portion 21 of the device. This upper portion may comprise a separate buoyancy element, e.g. integrated in the wall structure.

It should be mentioned that the invention may be modified in different ways without leaving the scope of the invention. Thus, different materials may be used if only corrosion resistant and compatible to seawater, GRP is only mentioned as one preferred material. The wall thickness may be rather small as the differential pressure does not have to be large, however, the wall thickness may be increased at desire, to give a stable and compact design enduring the prevailing pressure. Portions of the material may also have a pore structure and such pores/spaces may possibly be filled with a different gas than air. The internal pressure in the spaces 12 and/or in the pores included in a porous material, may preferably be substantially equal to the pressure in the surrounding water at the working level. However, the pressure may be increased to exceed the mentioned surrounding pressure, so that a certain over-pressure exists within the buoyancy element 12. Thus, it will be ensured that if a leak arises, the total buoyancy will be maintained until the leak is detected and the required precautions are taken. By separating the internal volume of the buoyancy device with several cross-wise partitions, the buoyancy along the buoyancy device 2 may be adjusted according to the weight of the cables 1 supported by each single chamber. If wanted, the buoyancy device may be provided with fastening or clamping members adapted to fasten the longitudinal element 2 to the element(s) 1.

What is claimed is:

1. A method for locally supporting a longitudinal element submerged in water, where such local support is obtained by means of a submerged saddle-shaped buoy being submerged in water and arranged underneath a portion of said element, wherein the saddle-shaped buoy is designed as one single piece completely consisting of a light-weight material being corrosion and water-resistant;

at least a portion of the saddle-shaped buoy is provided with an internal volume which is brought into communicating connection with the surroundings before the submerging into water takes place, so that the volume obtains an internal pressure equal to pressure in the surroundings when the saddle-shaped buoy is submerged; and said volume is filled with a gas sufficiently to buoy the saddle-shaped buoy and said element when the saddle-shaped buoy has reached a required depth.

2. A method according to claim 1, wherein the gas is air.

3. A method according to claim 1, wherein filling of said volume continues until an over-pressure is obtained within said volume.

4. A method according to claim 1, wherein a volume is filled with water or a liquid of a higher density than water to ballast the saddle-shaped buoy.

5. A saddle-shaped buoy adapted to support a longitudinal element submerged in water and passing between a sub-sea well and a floating device on the surface of the ocean, where the saddle-shaped buoy is hollow and comprises anchoring devises adapted to fasten the buoy to an anchor, wherein the complete saddle-shaped buoy is manufactured in one single piece from a lightweight material that is corrosion resistant and sea-water resistant;

the saddle-shaped buoy is one single structure comprising an internal chamber of at least such a size as to buoy the saddle-shaped buoy and the longitudinal element when filled with gas; and the internal chamber is provided with a valve adapted to be opened/closed to the surroundings.

6. A saddle-shaped buoy as claimed in claim 5, substantially arranged underneath the longitudinal element and having integrated in it a guiding recess wherein the radius of the curvature of said saddle-shaped buoy along said guiding recess is equal to or greater than a minimum allowable radius of curvature for said longitudinal element.

7. A saddle-shaped buoy as claimed in claim 5, wherein the buoy is provided with an additional buoyancy element having a constant buoyancy.

8. A saddle-shaped buoy as claimed in claim 7, wherein the additional buoyancy element is integrated in a wall of said saddle-shaped buoy.

9. A saddle-shaped buoy as claimed in claim 5, wherein the lightweight material is a laminated FRP material.

10. A saddle-shaped buoy as claimed in claim 5, wherein the longitudinal elements are riser cables.

11. A saddle-shaped buoy as claimed in claim 5, wherein the longitudinal elements are umbilicals.

* * * * *